US009002046B2

(12) United States Patent
Shennib et al.

(10) Patent No.: US 9,002,046 B2
(45) Date of Patent: Apr. 7, 2015

(54) METHOD AND SYSTEM FOR TRANSCUTANEOUS PROXIMITY WIRELESS CONTROL OF A CANAL HEARING DEVICE

(75) Inventors: Adnan Shennib, Oakland, CA (US); Victor Valenzuela, Hayward, CA (US); Jesse Lee Jones, Oakley, CA (US)

(73) Assignee: iHear Medical, Inc., San Leandro, CA (US)

( * ) Notice: Subject to any disclaimer, the term of this patent is extended or adjusted under 35 U.S.C. 154(b) by 294 days.

(21) Appl. No.: 13/539,128

(22) Filed: Jun. 29, 2012

(65) Prior Publication Data

US 2014/0003639 A1 Jan. 2, 2014

(51) Int. Cl.
*H04R 25/00* (2006.01)

(52) U.S. Cl.
CPC ..... *H04R 25/558* (2013.01); *H04R 25/554* (2013.01); *H04R 2225/023* (2013.01); *H04R 2225/61* (2013.01); *H04R 2460/03* (2013.01)

(58) Field of Classification Search
CPC .. H04R 25/558; H04R 25/554; H04R 25/505; H04R 25/552; H04R 25/70
USPC ..... 381/314, 315, 328
See application file for complete search history.

(56) References Cited

U.S. PATENT DOCUMENTS

| | | | |
|---|---|---|---|
| 5,327,500 | A | 7/1994 | Campbell |
| 5,553,152 | A | 9/1996 | Newton |
| 5,645,074 | A | 7/1997 | Shennib et al. |
| 5,659,621 | A | 8/1997 | Newton |
| 5,701,348 | A | 12/1997 | Shennib et al. |
| 5,785,661 | A | 7/1998 | Shennib et al. |
| 6,137,889 | A | 10/2000 | Shennib et al. |
| 6,473,513 | B1 | 10/2002 | Shennib et al. |
| 6,546,108 | B1 | 4/2003 | Shennib et al. |

(Continued)

FOREIGN PATENT DOCUMENTS

WO WO 99/07182 A2 2/1999

OTHER PUBLICATIONS

"Lyric User Guide" http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

(Continued)

*Primary Examiner* — Matthew Eason
*Assistant Examiner* — Sean H Nguyen
(74) *Attorney, Agent, or Firm* — Dorsey & Whitney LLP

(57) ABSTRACT

Examples of systems and methods of wireless control of a canal hearing device by applying a magnetic field on the skin at the temporomandibular region of the head are described. An exemplary hearing device may include one or more magnetic sensors for wireless activation by the magnetic end of a remote control device applied inconspicuously to the anterior of the external ear. The activation of a reed switch magnetic sensor within the canal hearing device may be decoded by the electronics of the hearing device to implement a control command, such as volume change, program setting change, ON, or OFF. According to examples described, wireless control of the canal hearing device may be implemented with a natural, comfortable, and inconspicuous hand-arm motion. In some embodiments, multiple reed switches may be arranged to selectively respond to a magnetic field applied within distinct "hot spot" regions, for separate remote control commands.

35 Claims, 12 Drawing Sheets

(56) References Cited

U.S. PATENT DOCUMENTS

| | | | | |
|---|---|---|---|---|
| 6,724,902 | B1 * | 4/2004 | Shennib et al. | 381/328 |
| 6,937,735 | B2 | 8/2005 | DeRoo et al. | |
| 6,940,988 | B1 | 9/2005 | Shennib et al. | |
| 7,016,511 | B1 | 3/2006 | Shennib | |
| 7,113,611 | B2 | 9/2006 | Leedom et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 8,467,556 | B2 | 6/2013 | Shennib et al. | |
| 8,571,247 | B1 | 10/2013 | Oezer | |
| 2002/0027996 | A1 | 3/2002 | Leedom et al. | |
| 2005/0249370 | A1 | 11/2005 | Shennib et al. | |
| 2005/0259840 | A1 | 11/2005 | Gable et al. | |
| 2005/0283263 | A1 | 12/2005 | Eaton et al. | |
| 2006/0210104 | A1 * | 9/2006 | Shennib et al. | 381/315 |
| 2010/0119094 | A1 | 5/2010 | Sjursen et al. | |
| 2011/0058697 | A1 * | 3/2011 | Shennib et al. | 381/314 |
| 2011/0206225 | A1 | 8/2011 | Møller et al. | |
| 2013/0243229 | A1 | 9/2013 | Shennib et al. | |
| 2013/0294631 | A1 | 11/2013 | Shennib et al. | |

OTHER PUBLICATIONS

"User Manual—2011", AMP Personal Audio Amplifiers.

* cited by examiner

METHOD AND SYSTEM FOR TRANSCUTANEOUS PROXIMITY WIRELESS CONTROL OF A CANAL HEARING DEVICE

TECHNICAL FIELD

Examples described herein relate to hearing devices, and include particularly hearing devices that are positioned in the ear canal for inconspicuous wear. This application is related to pending patent application Ser. No. 12/878,926, titled CANAL HEARING DEVICE WITH DISPOSABLE BATTERY MODULE, and Ser. No. 13/424,242, titled BATTERY MODULE FOR PERPENDICULAR DOCKING INTO A CANAL HEARING DEVICE, which are incorporated herein by reference in their entirety for any purpose.

BACKGROUND

This ear canal 10, as illustrated in FIG. 1 in the coronal view, is generally narrow and tortuous and is approximately 26 millimeters (mm) long from the canal aperture 11 to the tympanic membrane 15 (eardrum). The lateral part 12 is referred to as the cartilaginous canal due to the underlying cartilaginous tissue 16 beneath the skin 14. The medial part, proximal to the tympanic membrane 15, is rigid and referred to as the bony region 13 due to the underlying bone tissue 17. A characteristic first bend occurs roughly at the aperture 11 (FIG. 2) of the ear canal. A second characteristic bend occurs roughly at the bony-cartilaginous junction 8 and separates the cartilaginous region 12 and the bony region 13. The two bends inside the ear canal define a characteristic "S" shape (FIG. 2). The ear canal 10 is generally hidden from view (front and side) behind a backward projecting eminence known as the tragus 3 (FIGS. 2-4). The ear canal is also hidden from view from the back by the presence of the pinna 4 (also referred to as auricle). The dimensions and contours of the ear canal 10 vary significantly among individuals.

The lateral part of the external ear, represented by the ear canal 10, tragus 3, pinna 4 and concha cavity 5, generally comprises flexible cartilaginous tissue that moves in response to pressure, including the motion of the mandible 7 (jaw bone, FIG. 3). Anterior of the ear canal 10 and the tragus 3 regions is the temporomandibular joint region 20, defined by the condyle 6 (upper part of the mandible 7) articulating with the temporal bone 18 (part of the cranium). The temporomandibular joint region 20 (alternatively referred to herein as the condyle region) is generally anterior to the tragus 3 and not considered part of the ear anatomy, nor related to the human hearing physiology. Similar to the general structure of the ear, the cartilaginous tissue 16 separates the condyle 6 from the ear canal cavity 10 as shown in FIG. 2.

Placement of a hearing device inside the ear canal 10 is generally desirable for various electroacoustic advantages such as reduction of the acoustic occlusion effect, improved energy efficiency, reduced distortion, reduced receiver vibrations, and improved high frequency response. Canal placement may also be desirable for cosmetic reasons since the majority of the hearing impaired may prefer to wear an inconspicuous hearing device. A canal hearing device can be inserted entirely or partially inside the ear canal. In the context of this application, any hearing device inserted inside the ear canal, whether partially or completely, may be referred to as a canal hearing device. This includes what is known in the hearing aid industry as Completely In the Canal (CIC), In-The-Canal (ITC), and extended wear deep canal invisible types.

SUMMARY

The present disclosure describes examples of systems and methods of proximity wireless control of a canal hearing device by applying a magnetic field across the cartilaginous tissue anterior to the ear. In one example, a magnet is placed non-invasively at the temporomandibular region on the head to control a hearing device placed inside the ear. The canal hearing device may include one or more miniature magnetic sensors, preferably miniature reed switches which are adapted to be activated wirelessly by the magnetic end of the remote controller applied inconspicuously at the condyle region. The activation of a magnetic sensor within the canal hearing device may be decoded by the electronics of the hearing device to implement a specific control command, such as volume change, program setting change, ON, or OFF. In another example, sequential activation of a reed switch, i.e., by a sequence of magnetic field pulses, can be used to wirelessly implement a specific control command to the canal hearing device.

By placing the wireless control anterior of the external ear at the condyle region, wireless control of the canal hearing device is implemented by a natural, comfortable, and inconspicuous manner, instead of reaching back and pointing directly at, or into, the ear canal.

In some embodiments, two or more reed switches may be employed and arranged to selectively respond to magnetic field applied at select locations within the condyle region. The miniature reed switches may be arranged approximately 4 mm apart, and preferably within the range of 3 to 6 mm with respect to their centers. In some examples, the reed switches may be angled relative to each other at an angle within the range of 80-100 degrees, with respect to their longitudinal axes. In this manner, the reed switches may be used to create distinct "hot spot" areas at the condyle region of the head for separate remote control commands. In an example embodiment, the user may implement a specific hearing aid remote control command with minimal effort by pointing the magnetic end of the wireless controller within a specific location within the condyle region anterior of the tragus. In some examples, a first reed switch may be positioned for activation by placement of the magnetic end at a first location, for example the anterior superior region (with respect to the tragus) on the condyle region. Placement of the magnetic end at the first location may cause the first reed switch to be activated for implementing a first control command such as a volume increase for example. A second reed switch may be positioned within the canal hearing device for activation by placement of the magnetic end at a second location (e.g., "hot spot"). The second location, which may be at the anterior inferior region relative to the tragus, may be used to implement a second control command such as a volume decrease for example. Placement of the magnetic end directly on the skin may be valuable in providing tactile feedback for the user to differentiate hot spots. The tactile feedback may be particularly important since visual observation of the side of the head is generally difficult and not practical for the user. In some embodiments in which multiple reed switches are used, "hot spot" centers for controlling each of the respective reed switches may be spaced apart by at least about 6 mm for proper tactile operation.

In addition to selective location placement within the condyle region, different remote control commands may be implemented by varying the duration, or the pattern of magnetic field application. For example, the user can wirelessly select an alternate program setting for the canal hearing device by applying the magnet at the condyle region for a relatively long period of time exceeding about 2 seconds, versus a momentary application of less than about 2 seconds.

In examples, the magnetic sensor used in the present invention may preferably be micro-electro-mechanical (MEM) type reed switch for minimizing the size of the canal hearing devices. The operable control distance between the remote controller and the canal hearing device in situ may be within the range of about 9-22 mm. Other operable distances may be used, in some examples. One or more of the reed switches within the hearing device may be electrically connected to circuitry for detecting the closure and/or opening of the reed switches. Circuitry for decoding the pattern of opening and/or closure may be included and configured to implement specific wireless control commands, or to program the device. In some examples, a permanent magnet, which may be a rare-earth magnet, may be used to generate the magnetic field of the proximity wireless remote controller. However, other methods for generating transient magnetic fields, such as by using a coil magnet (e.g. electromagnet), as is well known in the field of magnetics, hearing aid programming and proximity wireless control, may also be used. Although the preferred magnetic sensor in the present invention is a reed switch, other types of magnetic sensor, such as a hall-effect sensor, may be used without departing from the scope of the present invention.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which.

DETAILED DESCRIPTION

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

Figure 6:
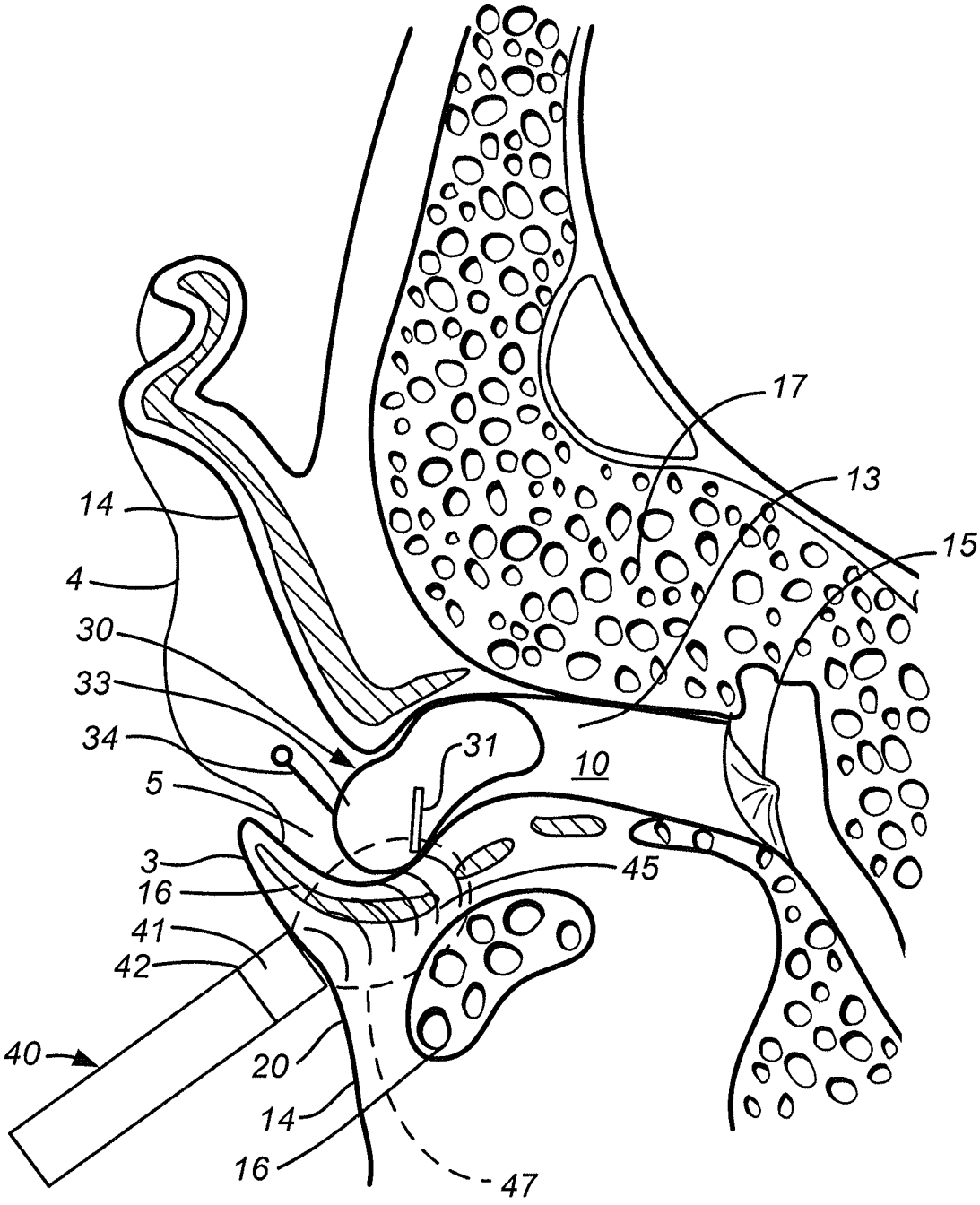
FIG. 6 is a view of an embodiment of the present invention with wireless controller applied to the head, anterior to the tragus at the condyle region, showing magnetic field crossing the cartilaginous region and into the ear canal where the canal hearing device resides.
Figure 7:
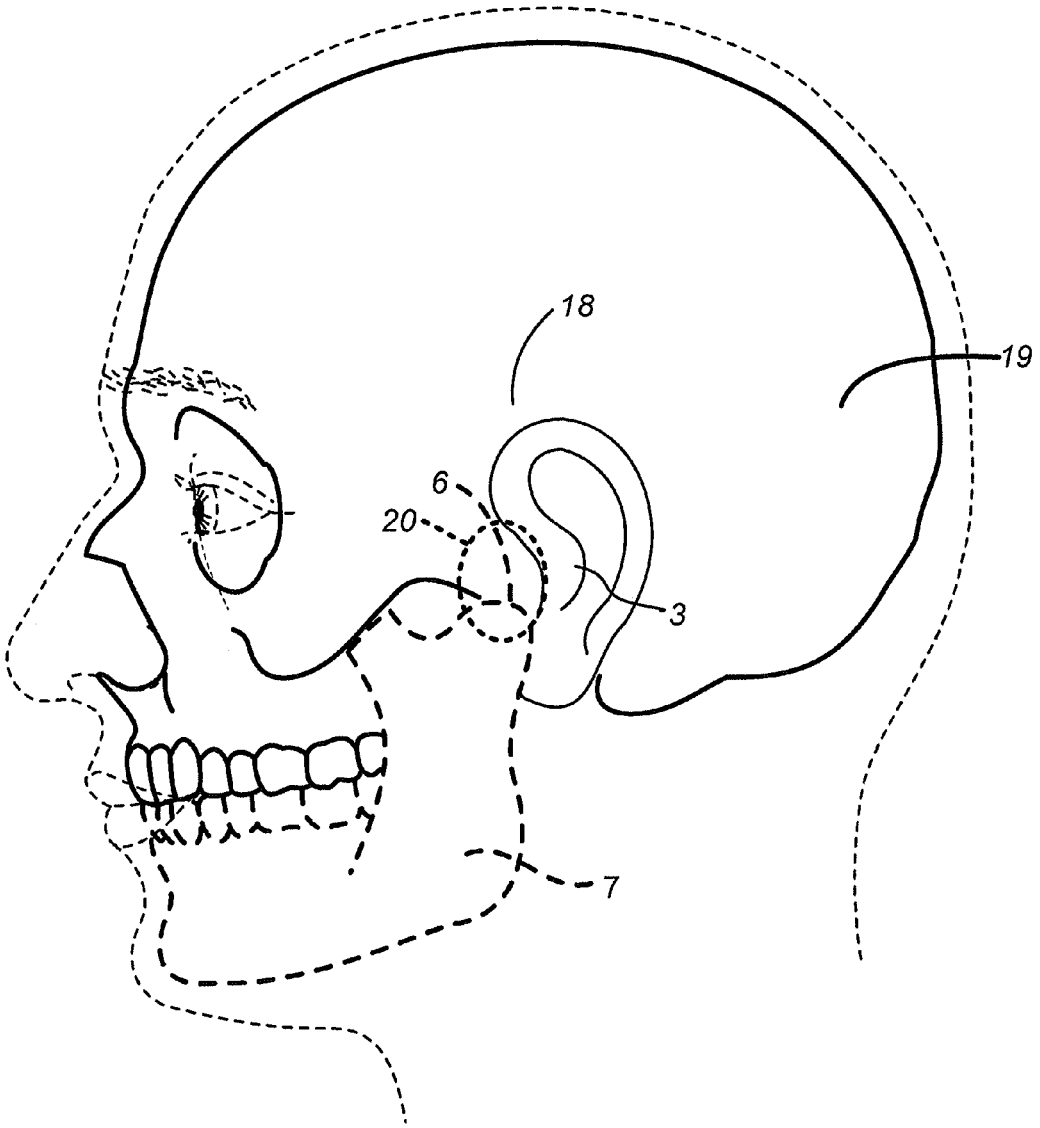
FIG. 7 is a side view of the head showing a "hot spot" region, generally at the temporomandibular region anterior to the external ear, for placement of a magnetic wireless controller of a canal hearing device (not shown) inside the ear canal.

Examples of systems and methods for proximity wireless control of canal hearing devices are described. FIG. 6 shows a top-down view (e.g. transverse view) of the ear canal and an exemplary system according to the present disclosure. An exemplary canal hearing device 30 configured for placement inside the ear canal 10 may include one or more reed switches 31 incorporated therein and configured to respond to a magnetic field 45 applied non-invasively anterior to the ear at the temporal bone region, and more specifically the temporomandibular joint region 20, and transmitted transcutaneously through cartilaginous tissue 16 to the in situ canal hearing device. In some examples and as depicted in FIG. 6, an exemplary system according to the present disclosure may include a hand-held wireless controller 40 configured to generate a magnetic field 45, the system further including a canal hearing device 30 configured for positioning inside the ear canal, the canal hearing device 3Q having one or more magnetic sensors incorporated therein. In the preferred examples, the magnetic sensor is one or more reed switches 31 configured to respond to the magnetic field 45 when the magnetic field 45 is applied non-invasively anterior to the ear at the temporomandibular joint region (e.g. anterior to the tragus 3), the field 45 being transmitted transcutaneously through the cartilaginous tissue 16 to the in situ canal hearing device 30. In this manner, the device 30 may be wirelessly and inconspicuously controlled (e.g. turned ON and OFF, changing a volume or program setting) without the user having to place and/or point a remote control device behind the tragus 3 and/or reaching into the concha cavity 5 of the ear canal 10.

In some examples, the hand-held wireless controller 40 may include a magnetic end 42. In some examples, the controller 40 may be a wand having a magnet attached at the medial end of the wand (e.g. the magnetic end). In examples, the magnetic end 42 may include a permanent magnet 41, or in examples, an electromagnet may be used. In examples, the controller 40 may include circuitry as may be needed to operate the controller 40. In some examples, the magnet 41 may be a rare-earth magnet. Any of a variety of magnetic field generation known in the art may be used without departing from the scope of the present disclosure. In some examples and as will be further described, one or more of the reed switches 31 of the canal hearing device 30 may be configured to change the volume of the canal hearing device 30 responsive to the application of the magnetic field 47 at a select location of the temporomandibular joint region (e.g. the condyle region 20). In some examples, one or more of the reed switches 31 of the canal hearing device 30 may be configured to change a program setting of the canal hearing device 30 responsive to the application of the magnetic field at a select location of the temporomandibular joint region.

In some examples, the one or more reed switches may include a first reed switch 31 and a second reed switch 32, wherein a first reed switch 31 is activated at a first position 21 of the wireless controller 40 within the temporomandibular region and a second reed switch 32 is activated at a second position 22 of the wireless controller 40 within the temporomandibular region. In some examples, the first and second positions 21, 22 of the wireless remote controller within the temporomandibular region for activating the first and second reed switches may be at least 6 mm apart (see, e.g., FIG. 8). Any of the reed switches or combinations thereof may be used in other examples according to the present disclosure.

The preferred magnetic sensor in the present invention is a reed switch since it is readily available in a highly integrated and well protected package, can be configured directional, consumes no power in the inactive state, and its output can be directly interfaced with a typical hearing aid processor. However, although less desirable in terms of power consumption, other types of magnetic sensor, such as a hall-effect sensor, may be used without departing from the scope of the present invention.

Figure 10:
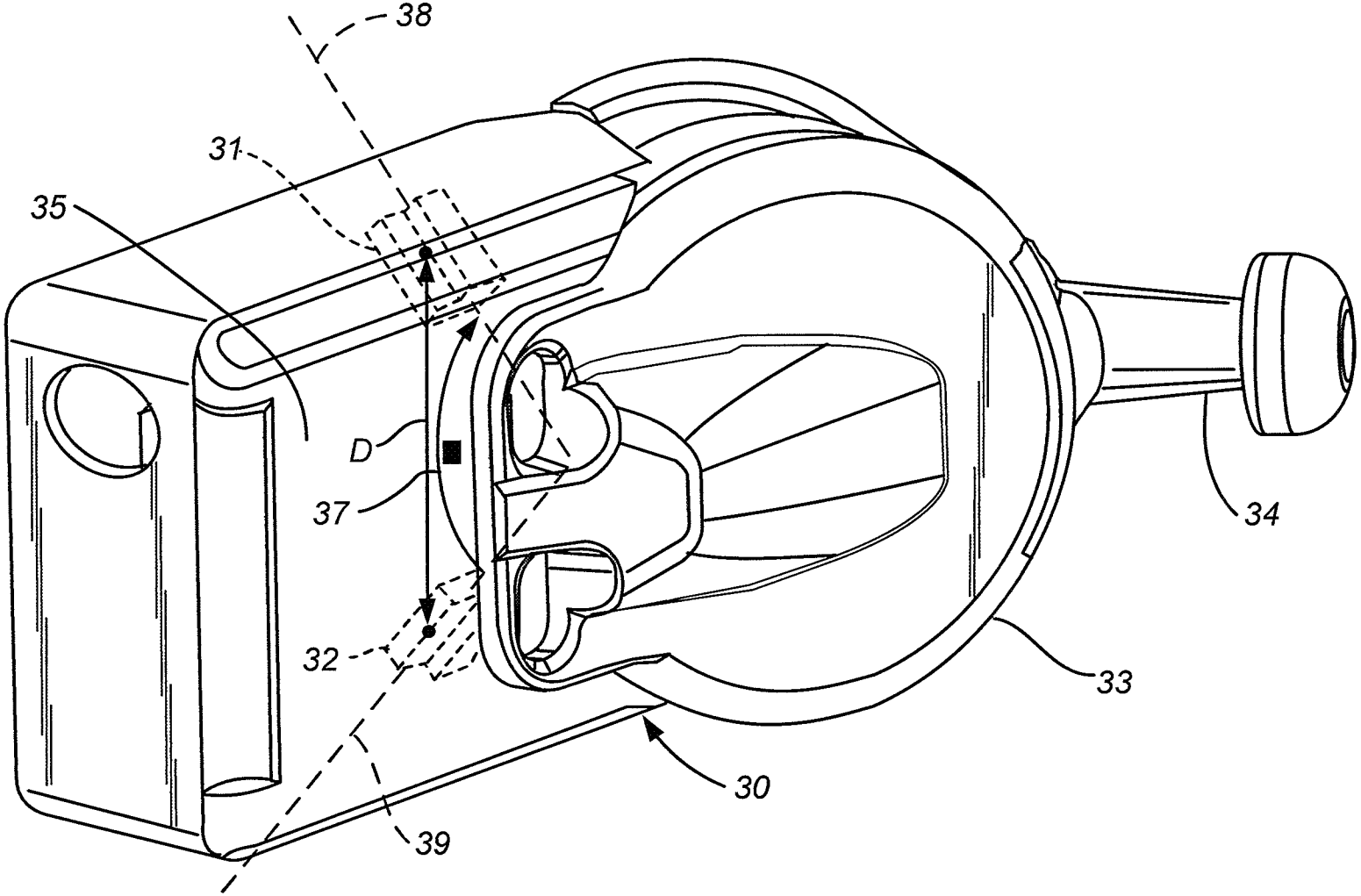
FIG. 10 is a view of the example canal hearing device of FIG. 9 showing two reed switches inside the device, and arranged approximately 4 mm apart, and oriented approximately at 90 degrees with respect to their longitudinal axis to achieve two "hot spot" regions with separation in excess of 6 mm at the skin surface within the temporomandibular (condyle) region.
Figure 11:
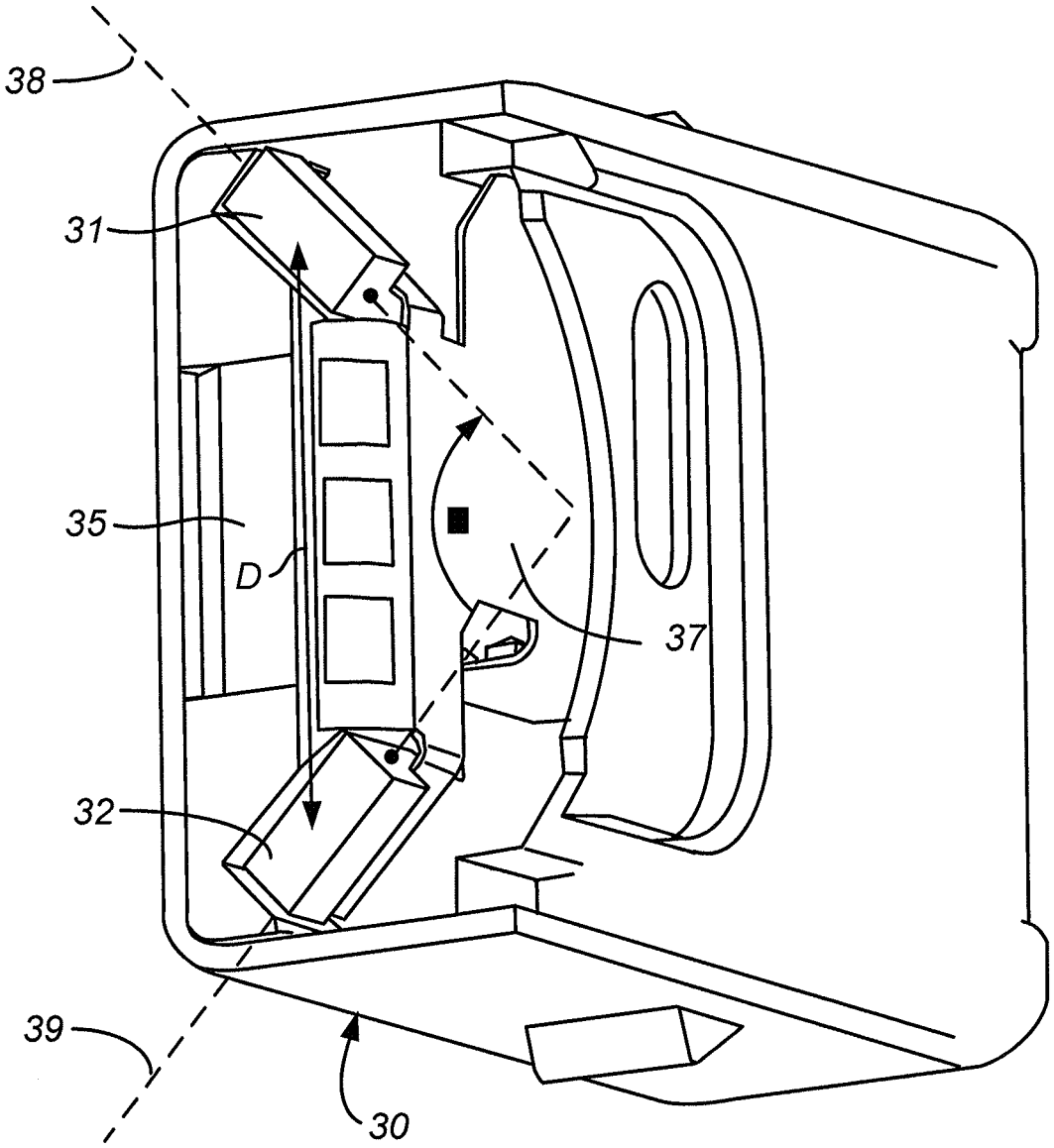
FIG. 11 is a cut-away view of the example canal hearing device in FIG. 10, showing in more details the spatial arrangement of two reed switches and their axial orientation of approximately 90 degrees with respect to each other.

In some examples, the first and second reed switches 31, 32 may be arranged such that a center of the first reed switch is spaced apart from a center of the second reed switch by about 3 mm to 6 mm (e.g. distance D depicted in FIGS. 10 and 11). In some examples, the first and second reed switches may be angled relative to one another defining an angle (θ) (37 in FIGS. 10 and 11) between longitudinal axes 38, 39 of the switches 31, 32. In some examples, the axial orientation (e.g. as defined by axis 38) of the first reed switch 31 may be angled from about 80 degrees to about 100 degrees relative to the axial orientation (e.g. as defined by axis 39) of the second reed switch 32. Other angular positioning of the reed switches may be used, and more than two reed switches may be used to effectuate different commands. The spacing and/or positioning of the reed switches may allow them to activate responsive to a magnetic field applied at various locations (e.g. "hot spots"), in some examples locations different than the examples described. Accordingly, the examples described herein are provided for illustration purposes only and are not to be taken as limiting.

In some examples, the one or more of the reed switches 31, 32 may be coupled to the hearing aid (e.g. device 30) to generate a volume change command. Thus as an example, volume may be increased responsive to placement of a magnetic end 41 of the wireless controller 40 at a position anterior superior to tragus 21. In some examples, volume may be decreased responsive to placement of the magnetic end 41 of the wireless controller 40 at a position anterior inferior to the tragus 22. In examples, the remote control command may be a program setting or selection, in which case, the activation of the one or more switches may, responsive to the placement of a magnetic end 41 at a select location of the condyle region, generate a signal from the reed switch to implement the desired command.

In some examples, the one or more of the reed switches 31, 32 may be configured to cause a volume change command in response to placing the wireless controller at the temporomandibular region for a period of less than about 2 seconds. In some examples, one or more of the reed switches 31, 32 may be configured to cause a program setting change command in response to placing the wireless controller at the temporomandibular region for a period of more than about 2 seconds. As will be understood, a different period of time, other than 2 seconds, may be used to delineate the various commands. In some examples, the one or more of the reed switches 31, 32 may be configured to generate an ON or an OFF command in response to placing the wireless controller within the temporomandibular region 22. In examples, the one or more magnetic sensors 31, 32 may be miniaturized micro electromechanical (MEM) type reed switches. In some examples, the wireless controller 40 may be configured to operate by contacting the skin 14 at the temporomandibular region 22.

As will be appreciated in light of the present disclosure, in contrast to conventional canal hearing devices and remote controls, the present disclosure describes systems and a methods for proximity wireless control of a canal hearing device 30 by applying a magnetic field 45 transcutaneously across the cartilaginous tissue 16, which field may be generated by a hand-held control device placed anterior to the ear, as shown in FIG. 6 for example. In some embodiments, a remote controller 40 with a magnet 41 at its medial end, referred to herein as magnetic end 42, is placed non-invasively at the temporomandibular region 20 (referred to herein alternatively as the condyle region) on the head 19 to control the hearing device 30 placed inside the ear cavity 10. The canal hearing device 30 may include one or more miniature magnetic sensors, preferably reed switches 31, 32 which may be activated wirelessly by the magnetic end 42 of the remote controller 40 applied inconspicuously at the condyle region 20 anterior to the ear. The activation (e.g. closing and/or opening) of a reed switch 31 within the canal hearing device 30 may be detected by the electronics (e.g., circuitry, not shown) of the canal hearing device 30 to implement a specific control command, such as volume change, program setting change, ON, or OFF. Alternatively, sequential activation of a reed switch, i.e., by a sequence of magnetic field pulses, may be used to wirelessly control and program the canal hearing device 30.

Figure 1:
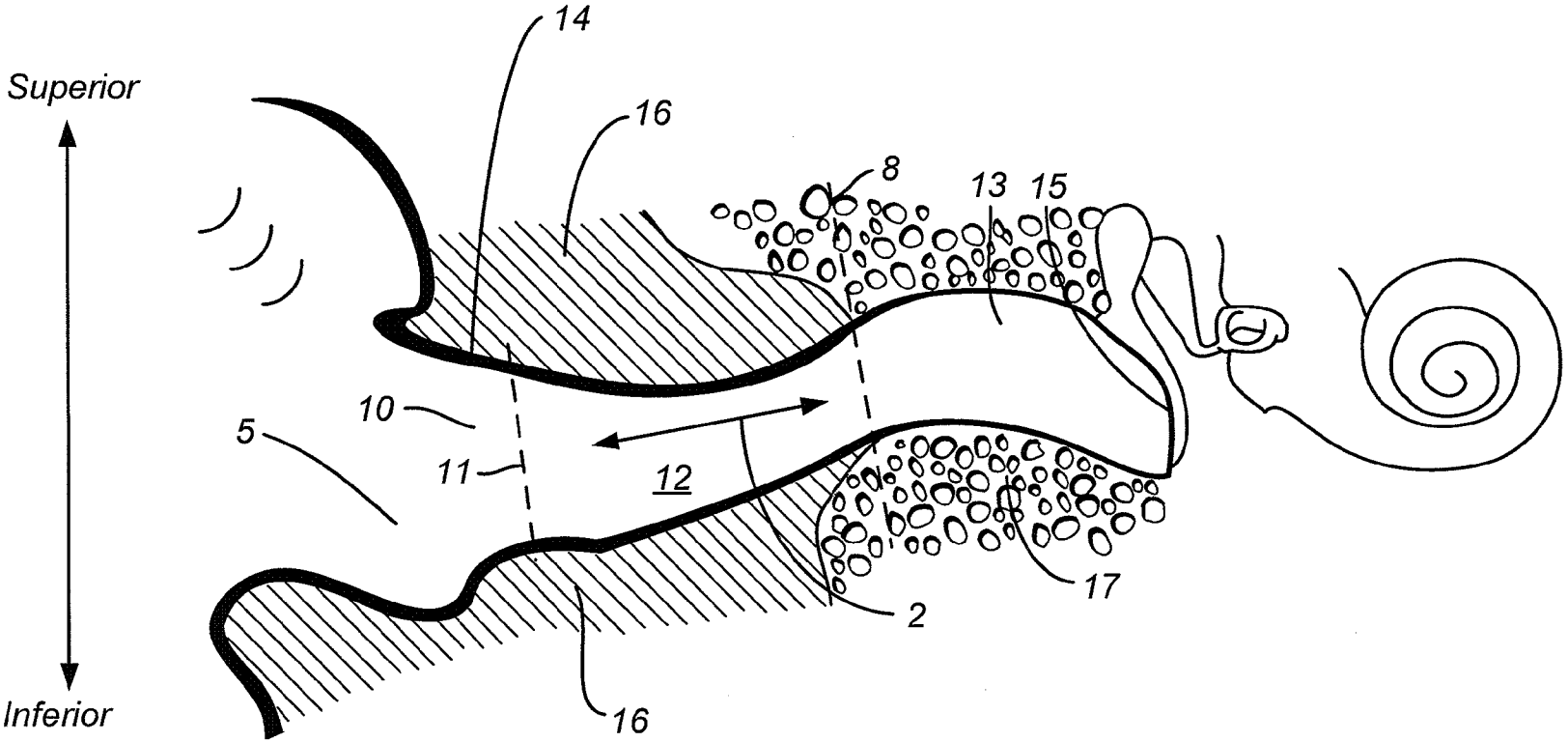
FIG. 1 is a coronal view of the ear canal showing the bony and cartilaginous tissue regions and the concha cavity.
Figure 2:
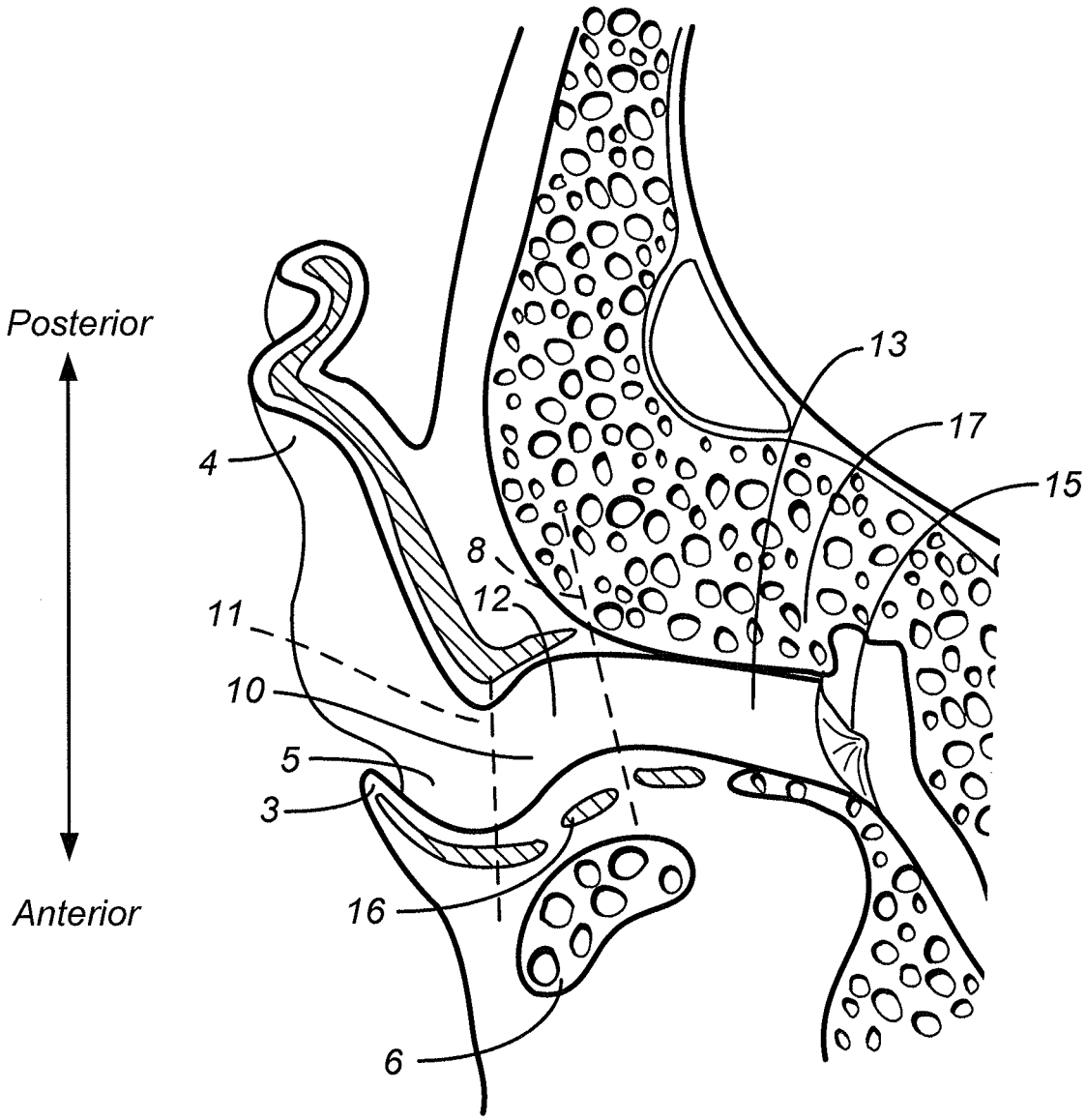
FIG. 2 is a transverse view of the ear canal, showing the first and second bends, as well as the lateral and anterior views of the tragus, the condyle of the mandible, and the cartilaginous tissue.
Figure 3:
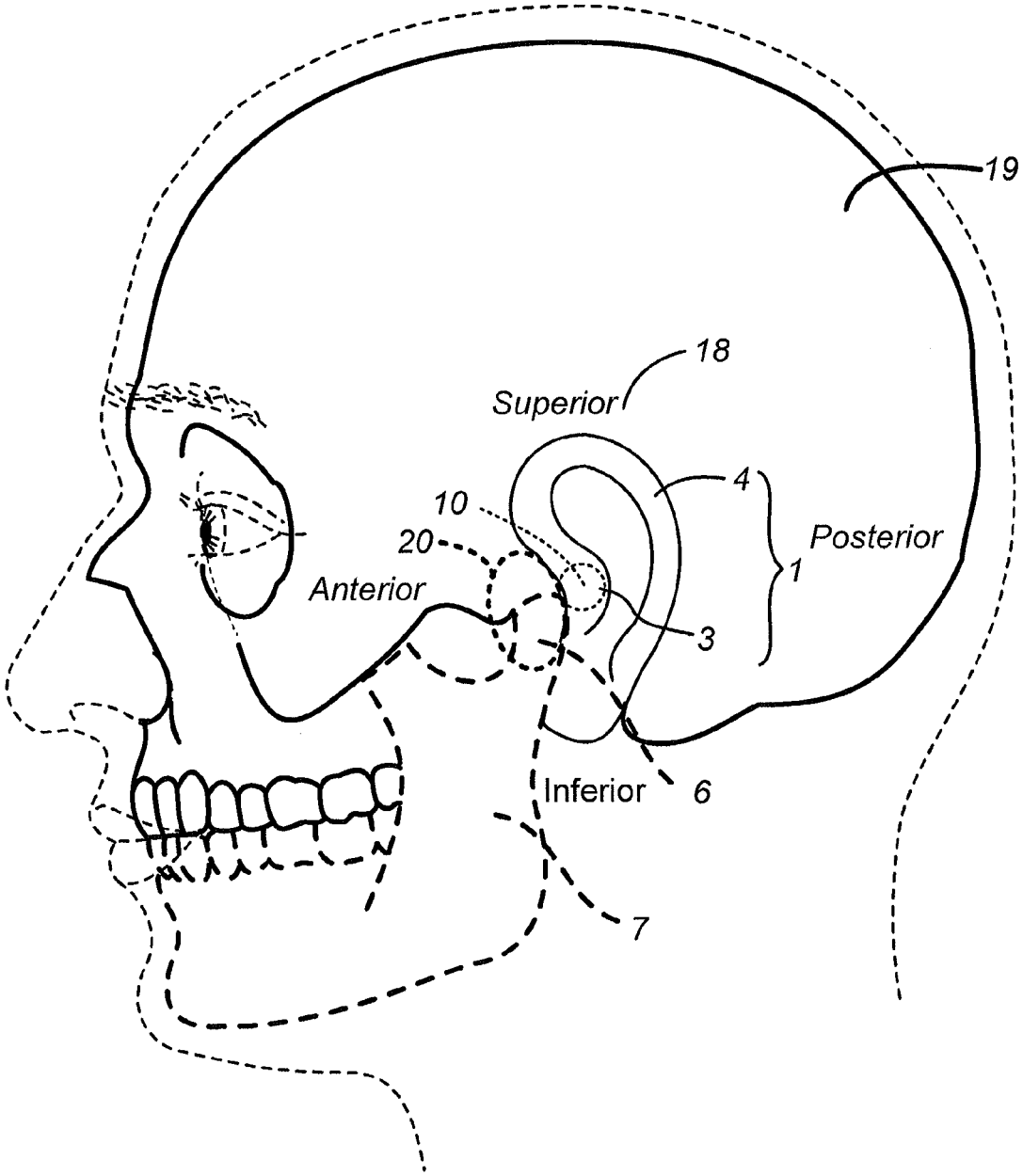
FIG. 3 is a side view of the head showing the external ear, tragus, and the temporomandibular (condyle) region, anterior to the tragus.
Figure 4:
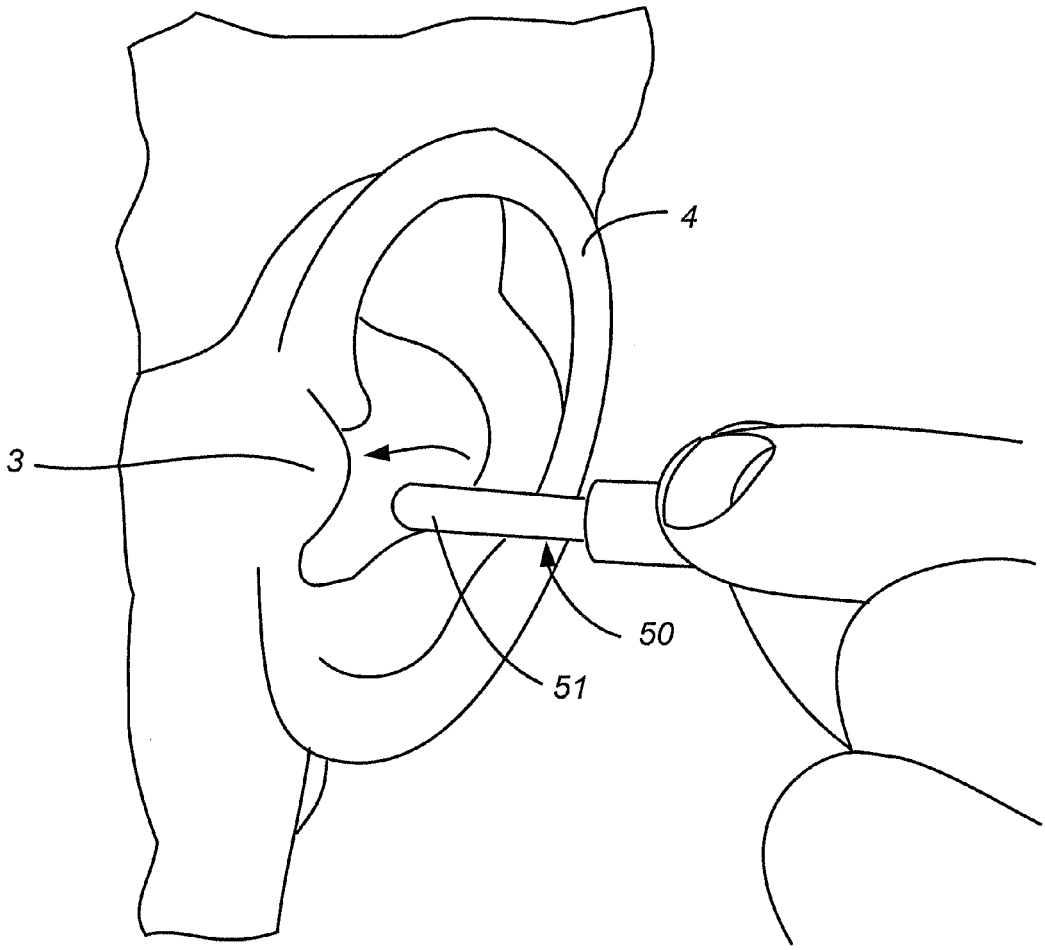
FIG. 4 (Prior Art)
FIG. 4 is an example of a conventional method for magnetic wireless control of a canal devices, showing the user applying the magnet end towards the ear canal, behind the tragus outside the ear canal.
Figure 5:
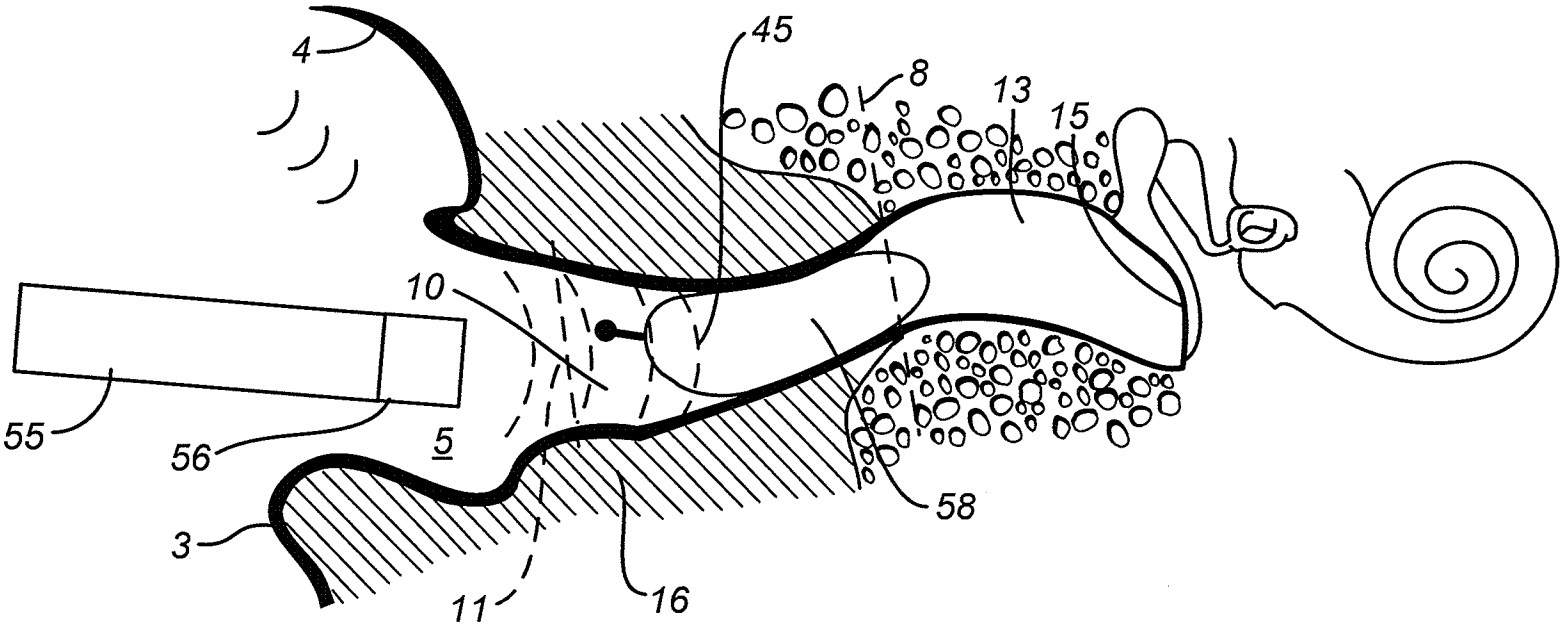
FIG. 5 (Prior Art)
FIG. 5 is another example of a conventional method for magnetic wireless control of deep canal devices, showing the user applying the magnet end into the ear for wireless control.

By placing the wireless remote controller 40 anterior of the external ear at the condyle region 20, wireless control of the canal hearing device 30 may be implemented in a relatively inconspicuous manner. This is partly due to the fact that self-touching the head generally anterior of the ear is part of normal human behavior and thus does not draw attention. For example it is not uncommon for a person to be scratching the temporal bone region of the head by the index finger, or by a writing implement, during thinking. This normal, inconspicuous act is in contrast to prior art remote control methods whereby the user reaches back and points directly at the ear canal, as shown in FIG. 4, with the magnetic remote control 50 and its magnetic end 51 applied directly at the ear, and specifically behind the tragus 3 towards the CIC device (not shown) inside the ear canal cavity 10. FIG. 5 shows a more conspicuous prior art remote control method with remote control 55 and magnetic end 56 reaching into the ear canal cavity 10 to control the extended wear deep canal hearing device 58.

Figure 8:
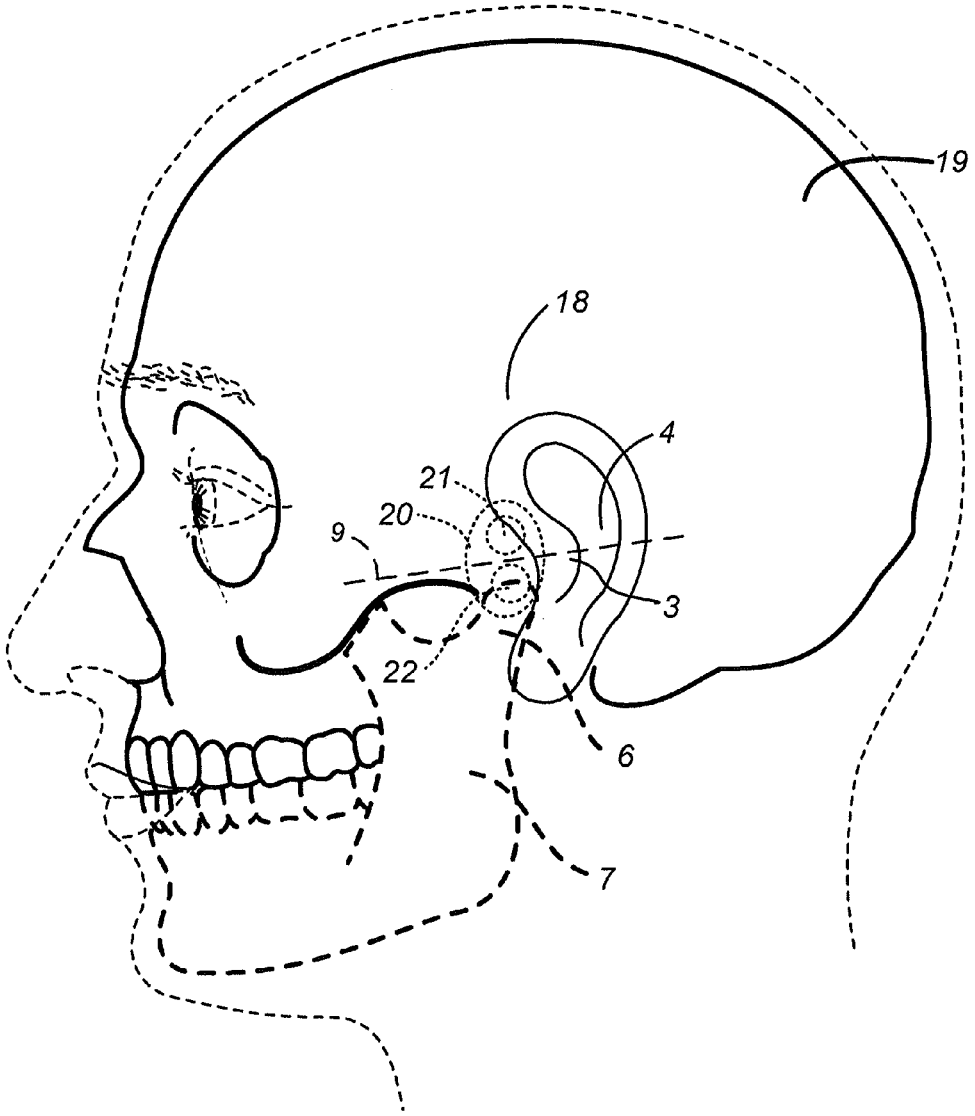
FIG. 8 is a side view of the head showing two "hot spot" regions, generally at the temporomandibular region anterior to the external ear, with first "hot spot" region above the tragus line, and second "hot spot" region below tragus line, for achieving separate wireless control commands for a canal hearing device (not shown) inside the ear canal.
Figure 9:
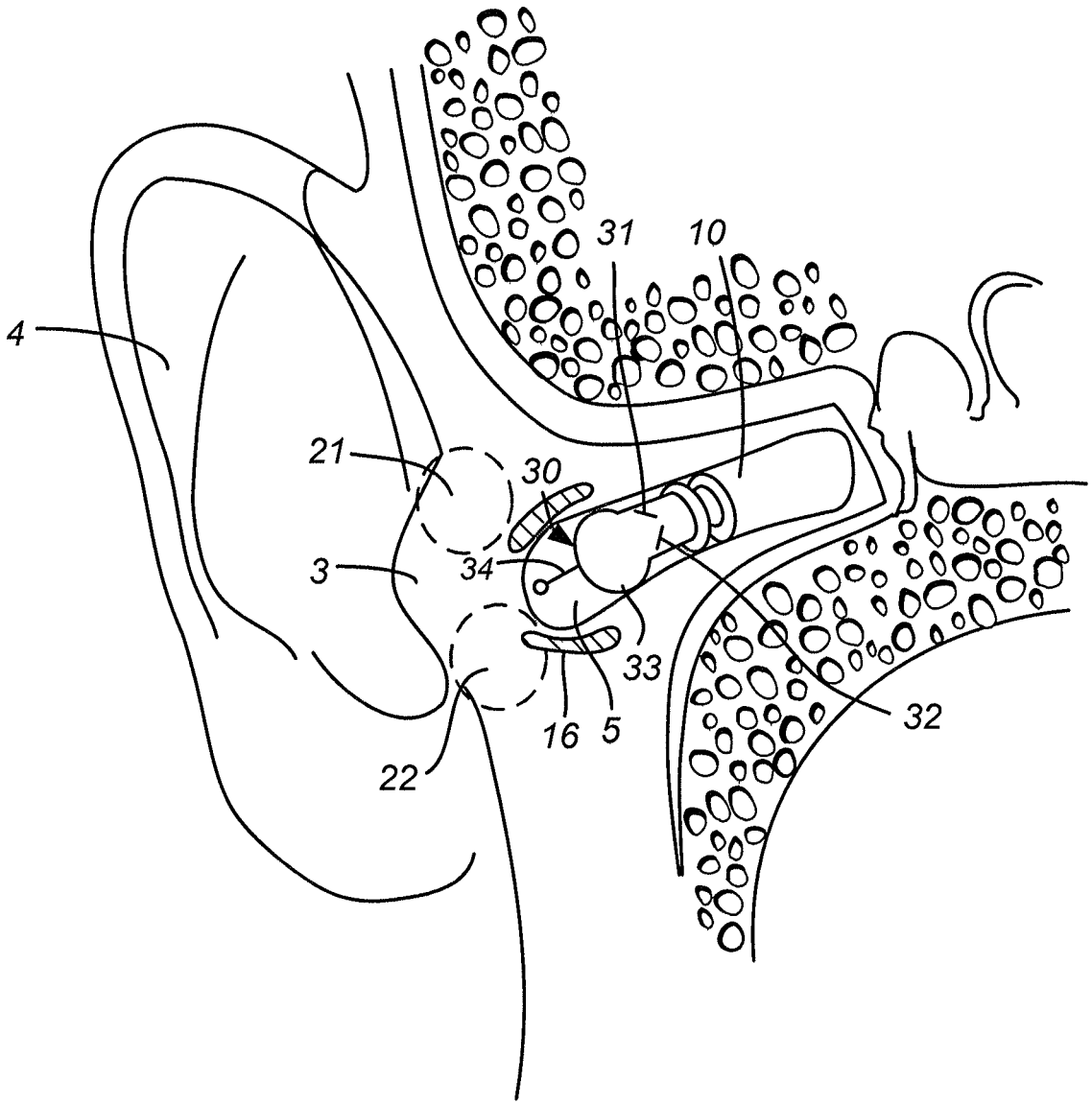
FIG. 9 is a frontal-side cut-away view of the embodiment of FIG. 8 with two "hot spot" regions showing the canal hearing device inside a cross section of the ear canal in the coronal view.

Referring to the example shown in FIGS. 9 and 10, two or more reed switches may be employed and arranged to selectively respond to magnetic field 45 applied within select locations or positions at the condyle region 20. The miniature reed switches 31 and 32 may be arranged so that they are spaced apart at a distance D. In some examples, the reed switches 31 and 32 may be approximately 4 mm apart, and in some examples within the range of 3 to 6 mm with respect to their centers as shown in more detail in FIGS. 10 and 11. The reed switches 31 and 32 may be oriented at an angle (θ) 37 of approximately 90 degrees, preferably within the range of 80-100 degrees, with respect to the longitudinal axes (38 & 39) of the reed switches. The example arrangement creates a superior (upper) "hot spot" region 21, and an inferior (lower) "hot spot" region 22, within the condyle region 20 as shown in FIGS. 8 and 9. In these example embodiments, the user implements a specific remote command with minimal effort by pointing the magnetic end 42 at a specific location (e.g. the locations 21, 22) within the condyle region 20 anterior of the tragus 3. By configuring the reed switches 31, 32 within the device 30 at the specific spacing and orientations, a wireless remote control of the device 30 in proximity may be achieved by placing the remote control device 40 at the respective hot spot corresponding to the desired command.

Figure 12:
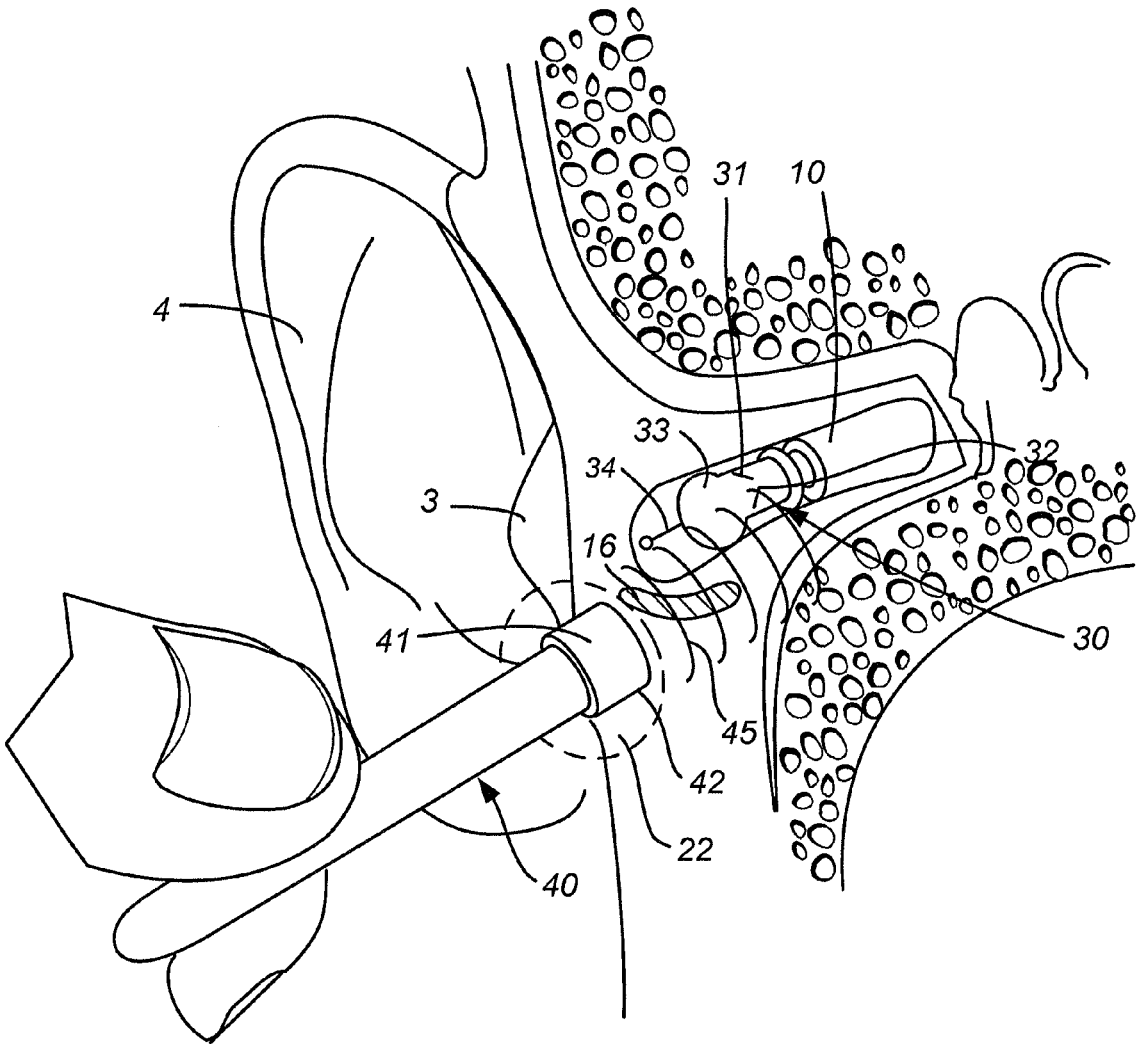
FIG. 12 is a frontal-side view of the embodiment of FIGS. 9-11, showing placement of magnetic end of wireless controller at the lower "hot spot" of the condyle region to wirelessly activate the lower (second) reed switch within the canal hearing device to decrease the volume of the canal device in situ.

In an example embodiment, a first reed switch 31 may be positioned for activation by a magnetic field at the first hot spot 21 (anterior superior with respect to the tragus and above the tragus line 9) on the condyle region 20 and the device 30 may be configured to implement a first control command, such as a volume increase, upon activation of the first reed switch 31. In the second "hot spot" position 22, which may be anterior with respect to the tragus and inferior relative to the first position 21, a second reed switch 32 may be activated to implement a second control command, such as a volume decrease (as shown in FIGS. 8 and 12). Placement of the magnetic end 41 of the remote controller 40 directly on the skin 14 on the head 19 may be valuable in providing tactile feedback for the user to properly position the remote controller 40 at the designated "hot spot" within the condyle region 20. Tactile feedback can be important since self visual observation of the condyle region is generally not practical, particularly when dealing with multiple "hot spots" within relatively close proximity to each other. In some embodiments in which multiple reed switches are used, as shown in FIGS. 9-12, hot spot regions may be spaced apart by at least about 6 mm (center to center) to facilitate proper localization of each control region.

In addition to selective hot spot placement, additional control commands can be implemented by varying the duration, or the pattern of magnet application on the condyle region 20. For example, the user can select an alternate program setting by applying the magnet 41 at the condyle region for a relatively long period of time exceeding about 2 seconds, versus a momentary application of less than about 2 seconds.

In examples according to the present disclosure, micro-electro-mechanical (MEM) type reed switches may be used to minimize the size of the canal hearing devices 30. The canal hearing device 30 may be configured such that it is responsive to the application of a magnetic field or magnetic field pulse within an operating distance. The operating distance between the reed switch 31 or 32, for example, and the magnetic end 42 of the remote controller 40 when positioned at the condyle region 20, may be within the range of about 9-22 mm, depending on the position of the canal hearing device within the ear canal. In the example embodiment shown in FIGS. 6 and 9, the canal hearing device is placed substantially in the ear canal with lateral section 33 and handle 34 (FIGS. 9 and 10) placed in the concha cavity 5. The operable magnetic field range 47 (FIG. 6) from the magnetic field 45 emanating from the magnetic end 42 may be approximately 25 mm in some examples. This range may be obtained from a rare earth magnet such as Neodymium-Iron-Boron (NdFeB). In an example embodiment, a remote controller 40 was fabricated with a magnet 41 made of nickel plated NdFeB magnet disk having a diameter of 6.4 mm, thickness of 3.2 mm, magnetic field intensity of approximately 40 Mega Gauss Oersted (MGOe), and magnetized across the thickness. The magnetic field intensity in some embodiments may be within the range of 20-45 MGOe which may generally be obtained from rare-earth magnets, including Samarium Cobalt type. As will be understood, other types and shapes of magnets can be used to generate the desired magnetic field according to the size and cost requirements. Although a permanent magnet may typically be used to generate high intensity field from a relatively small package, other methods for generating transient or pulsed magnetic field, such as by a coil magnet and circuitry, are well known in the field of magnetics, hearing aid programming and proximity wireless control.

In examples, the reed switch within the hearing device 30 is normally electrically connected to circuitry (not shown) within the hearing device 30, which is configured for detecting the closure and/or opening of the reeds, and the pattern of closure/opening. As described and as will be appreciated a great of variety of magnetic field, pulse patterns may be generated and detected for implementing a variety of wireless control commands, or for programming the device.

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A system for proximity wireless control of a canal hearing device comprising:

a hand-held wireless controller configured to generate a magnetic field for transmittance transcutaneously through a cartilaginous tissue of an ear; and a canal hearing device configured for positioning laterally in an ear canal of the ear, the canal hearing device having one or more reed switches incorporated within the canal hearing device, wherein one or more of the reed switches are positioned within a cartilaginous region of the ear and are oriented to respond to the magnetic field when the magnetic field is applied non-invasively exterior to the ear and anterior to a tragus at a temporomandibular joint region, said magnetic field being transmitted transcutaneously through the cartilaginous tissue to the canal hearing device for control of the canal hearing device while the hand-held wireless controller remains outside of the ear canal.

2. The system of claim 1, wherein the hand-held wireless controller comprises a magnet.

3. The system of claim 2, wherein one or more of the reed switches are configured to cause a change in a volume of the canal hearing device responsive to the application of the magnetic field at the temporomandibular joint region.

4. The system of claim 1, wherein one or more of the reed switches are configured to cause a change in a program setting of the canal hearing device responsive to the application of the magnetic field at the temporomandibular joint region.

5. The system of claim 1, wherein the operable distance of the magnetic end of the wireless controller with respect to said one or more reed switches is in the range of about 9 mm to about 22 mm.

6. The system of claim 1, wherein a first reed switch is activated at a first position of the wireless controller within the temporomandibular region and a second reed switch is activated at a second position of the wireless controller within the temporomandibular region.

7. The system of claim 6, wherein the first and second reed switches are arranged such that a center of the first reed switch is spaced apart from a center of the second reed switch by about 3 mm to 6 mm.

8. The system of claim 6, wherein the first and second positions of the wireless remote controller are at least 6 mm apart.

9. The system of claim 6, wherein an axial orientation of the first reed switch and an axial orientation of the second reed switch are approximately 80 degrees to 100 degrees with respect to one another.

10. The system of claim 1, wherein one or more of the reed switches are configured to cause a volume of the canal hearing aid to increase responsive to placing the wireless controller at a position anterior superior to tragus.

11. The system of claim 1, wherein one or more of the reed switches are configured to cause a volume of the canal hearing aid to decrease responsive to placing the wireless controller at a position anterior inferior to the tragus.

12. The system of claim 1, wherein one or more of the reed switches are configured to cause a change in volume responsive to placing the wireless controller at the temporomandibular region for a period of less than about 2 seconds.

13. The system of claim 1, wherein one or more of the reed switches are configured to cause a change in program setting of the canal hearing device responsive to placing the wireless controller at the temporomandibular region for a period of more than about 2 seconds.

14. The system of claim 1, wherein one or more of the reed switches are configured to cause the canal hearing device to be turned ON or OFF responsive to placing the wireless controller within the temporomandibular region.

15. The system of claim 1, wherein the wireless controller is configured to operate by contacting the skin at the temporomandibular region.

16. The system of claim 1, wherein said one or more reed switches are of microelectromechanical (MEM) type.

17. A method for wirelessly controlling a canal hearing device positioned laterally inside an ear canal of an ear, the method comprising:

positioning a remote control device external to the ear and anterior to a tragus;

transmitting a magnetic field generated by the remote control device transcutaneously into the canal hearing device through cartilaginous tissue present between the remote control and the canal hearing device;

activating a reed switch incorporated within the canal hearing device in response to the magnetic field, wherein the reed switch is positioned in a cartilaginous region of the ear and wherein the reed switch is oriented to generate a control command based on the activation of the reed switch while the remote control device remains outside of the ear canal and anterior to the tragus.

18. The method of claim 17, wherein the control command is a change of volume of the canal hearing device.

19. The method of claim 17, wherein the control command is a change of program setting of the canal hearing device.

20. The method of claim 17, wherein the remote control is configured for contacting the skin at the temporomandibular region.

21. The method of claim 17, further comprising activating a first reed switch by positioning the remote control device at a first position at the temporomandibular region and activating a second reed switch by positioning the remote control device at a second position at the temporomandibular region.

22. The method of claim 21, wherein a center of the first reed switch is spaced apart within the range of about 3 mm to 6 mm with respect to a center of the second reed switch.

23. The method of claim 21, wherein the first position and the second position of the remote control device at the temporomandibular region are at least 6 mm apart.

24. The method of claim 21, wherein an axial orientation of the first reed switch is approximately within the range of 80 to 100 degrees with respect to the second reed switch.

25. The method of claim 17, wherein said positioning the remote control device includes placing the remote control device anterior superior to tragus to increase the volume of the canal hearing device.

26. The method of claim 17, wherein said positioning the remote control device includes placing the remote control device anterior inferior to the tragus to decrease the volume of the canal hearing device.

27. The method of claim 17, further comprising maintaining the remote control device at the temporomandibular region for a period of less than about 2 seconds to generate a volume change command.

28. The method of claim 17, further comprising maintaining the remote control device at the temporomandibular region for a period of more than about 2 seconds to generate a change in program setting.

29. The method of claim 17, wherein the control command comprises an ON or an OFF command.

30. The method of claim 17, wherein said positioning the remote control device externally at the temporomandibular region includes providing a magnetic end of the remote control device within a distance of about 9 mm to about 22 mm relative to the reed switch of the canal hearing device.

31. A system for wirelessly controlling a canal hearing device comprising:

a remote control device configured to transmit a magnetic field for transmittance transcutaneously through a cartilaginous tissue of an ear; and a canal hearing device configured for positioning laterally inside an ear canal of the ear, the canal hearing device having a plurality of magnetic sensors incorporated therein, wherein said magnetic sensors are positioned in a cartilaginous region of the ear and oriented to selectively respond to the magnetic field from the remote control device when said remote control device is positioned non-invasively exterior to the ear and anterior to a tragus at a temporomandibular region for transmitting the magnetic field transcutaneously to any of the magnetic sensors through the cartilaginous tissue between the remote control device and any of the magnetic sensors while the remote control device remains outside of the ear canal.

32. The system of claim 31, wherein said magnetic sensors are reed switches.

33. A method of wirelessly controlling a canal hearing device positioned laterally inside an ear canal of an ear comprising:

positioning a remote control device non-invasively external to the ear and anterior to a tragus;

transcutaneously transmitting a magnetic field from the remote control into the canal hearing device through cartilaginous tissue therebetween to selectively activate one of multiple magnetic sensors incorporated within the canal hearing device positioned laterally inside the ear canal, wherein at least one of the magnetic sensors is oriented to respond to the magnetic field when the magnetic field is transmitted non-invasively exterior to the ear and anterior to the tragus; and decoding the activation of one or more magnetic sensors by the canal hearing device to implement a control command within said canal hearing device while the remote control device remains outside of the ear canal.

34. A canal hearing device configured for lateral placement inside an ear canal of an ear, the canal hearing device having one or more magnetic sensors incorporated therein and positioned in a cartilaginous region of the ear, wherein the one or more magnetic sensors are oriented to respond to a magnetic field source applied non-invasively exterior to the ear and anterior to a tragus at a temporomandibular joint region and transmitted transcutaneously to the one or more magnetic sensors through cartilaginous tissue present between the magnetic field source and the canal hearing device so that the canal hearing device is configured to be controlled while the magnetic field source is outside of the ear canal.

35. The canal hearing device of claim 34, wherein said one or more magnetic sensors are reed switches.

* * * * *